United States Patent [19]

McCain

[11] Patent Number: 4,538,962

[45] Date of Patent: Sep. 3, 1985

[54] MARINE PROPELLER LOCK

[76] Inventor: Conrad L. McCain, 613 S. First St., Atwood, Kans. 67730

[21] Appl. No.: 573,485

[22] Filed: Jan. 24, 1984

[51] Int. Cl.[3] ..... B63H 1/20

[52] U.S. Cl. ..... 416/146 R; 416/244 B

[58] Field of Search ..... 416/146 R, 146 A, 146 B, 416/245 R, 245 A, 245 B, 244 B; 70/232

[56] References Cited

U.S. PATENT DOCUMENTS

| | | | |
|---|---|---|---|
| 2,351,356 | 6/1944 | Meyer | 416/146 B X |
| 2,732,021 | 1/1956 | Taft | 416/245 A |
| 2,856,213 | 10/1958 | Hutchinson | 416/244 B X |
| 3,228,482 | 1/1966 | Bunyan | 416/244 B X |
| 3,732,033 | 5/1973 | Macchi | 416/244 B |
| 3,759,076 | 9/1973 | Reese | 70/232 |
| 3,792,938 | 2/1974 | Wilde | 416/146 B X |
| 3,831,401 | 8/1974 | Hurwitz | 416/244 B X |
| 3,901,627 | 8/1975 | Sullivan | 416/245 |
| 3,981,165 | 9/1976 | Wersinger | 70/232 |
| 3,981,617 | 9/1976 | Milewicz | 416/244 B |
| 4,077,742 | 3/1978 | Goodwin | 416/245 A |
| 4,257,247 | 3/1981 | Sims | 70/232 |

FOREIGN PATENT DOCUMENTS

| | | | |
|---|---|---|---|
| 143678 | 3/1964 | U.S.S.R. | 416/244 B |
| 463583 | 5/1975 | U.S.S.R. | 416/244 B |

*Primary Examiner*—Everette A. Powell, Jr.
*Attorney, Agent, or Firm*—James E. Pittenger

[57] ABSTRACT

A marine propeller locking device for securing a propeller to the drive shaft of a marine engine. The locking device includes a suitable retaining nut, exterior cover covering the retaining nut and preventing access, and a retaining bolt for mounting the cover on the retaining nut. A cylindrical surface is provided on the end of the retaining nut which compliments a like surface on the interior portion of the cover. A pair of O-rings are suitably mounted on the surface of the retaining nut and allow the cover to turn with respect to the nut yet maintaining a waterproof seal therebetween. The O-rings are spaced longitudinally a suitable distance to provide transverse support and stability for the cover. The head of the retaining bolt has a specific groove pattern which is matched by a companion wrench so that the bolt cannot be removed by an unauthorized person using common ordinary tools. A cap having a waterproof seal is positioned over the end of the cover so as to seal the internal cavity. Various outer surface configurations can be provided for the cover and adjoining cap with an ellipsoid or bullet shape suggested to eliminate any attaching or gripping surfaces on the outer surface of the cover.

9 Claims, 4 Drawing Figures

MARINE PROPELLER LOCK

FIELD OF THE INVENTION

This invention is directed to an improved lock for securing a propeller to the shaft of an outboard marine engine. It is more specifically directed to a sealed locking arrangement for securing a propeller to a drive shaft which remains on the shaft at all times and provides a waterproof interior to eliminate corrosion and contamination.

BACKGROUND OF THE INVENTION

Various types of locking mechanisms have been attempted in the past to secure a propeller to prevent its unauthorized removal or theft. In recent years this has become a major problem especially as the cost of propellers has escalated.

Two major problems presently exist in this type of product. One problem is the necessity to provide a locking mechanism which can be left on the shaft at all times. Many of the devices in the past have been mechanisms which must be installed when the boat and engine have been removed from the water for transportation or storage. The real problem is encountered when the boat and engine are returned to service and placed in the water for use. If the locking mechanism is forgotten and not removed considerable vibration and possible damage can occur to the propeller, shaft and engine drive train.

The second problem deals with the question of corrosion. In many cases the locking mechanism, out of necessity, is formed from dissimilar metals which causes a galvanic corrosion effect when the lock is in contact with the water. This type of corrosion is greatly accelerated when the engine is used in saltwater.

Corrosion in many cases causes failure or weakening of the lock materials and difficulty in removing the locking mechanism when desired so that the propeller can be either changed, repaired or removed when necessary. Thus, when the owner desires to remove the propeller and is prevented from doing so by the locking mechanism, the entire advantage of utilizing the mechanism in the first place has been lost with any further use of a locking device rendered questionable.

The present invention is directed to a unique type of locking arrangement which prevents the unauthorized removal of the propeller and yet maintains a waterproof condition for the internal parts which prevents corrosive action and allows the mechanism to be easily removed and installed when desired. In turn, the mechanism can remain on the shaft at all times and is quite inexpensive to manufacture and maintain.

INFORMATION DISCLOSURE STATEMENT

The following information refers to the most pertinent patents to which the applicant is aware with respect to the subject matter of the present invention. This statement is believed to comply with the applicant's acknowledged duty to inform the Patent and Trademark Office of any pertinent information of which he is aware.

The Milewicz patent (U.S. Pat. No. 3,981,617) discloses a locking device for marine propellers which is mounted on the output shaft of the motor. The locking device comprises a threaded fastener which is mounted on the shaft and a cylindrical cover member having a portion surrounding the fastener. A tumbler type key lock is insertable through the opening in the end of the cover and has outwardly extending tabs which engage slots provided on the inside of the fastener to hold the cover in position. Contrary to the present invention, apertures are provided in the fastener which allows a continuous flow of water around and through the locking mechanism.

The patent which issued to Macchi (U.S. Pat. No. 3,732,033) discloses a marine propeller locking device which has an enclosure which is retained on the shaft along with the propeller by a threaded nut. A locking cover has an edge which is recessed in the enclosure and engages the inside diameter of the enclosure by releasable tabs. The internal mechanism of the device is open to the infiltration of water. A tumbler type key lock is disclosed for retaining the cover in position.

The patent to Reese (U.S. Pat. No. 3,759,076) shows a cylindrical cover which is positioned over the propeller retaining nut and is held in place by a hook and lock assembly which engages a hub strut provided on the propeller. Obviously, this device could not be left on the propeller during actual use.

The Sims patent (U.S. Pat. No. 4,257,247) is a similar device in that it is merely a cover which is positioned over the hub of the propeller and retained in position by a chain and lock arranged behind the propeller blades. Considerable damage to the propeller and possibly the shaft would occur if this device were allowed to remain on the propeller during use.

The Worsinger patent (U.S. Pat. No. 3,981,165) shows a severable shell-type cover which is positioned over the hub of the propeller and has a lock for retaining the sections in place. It is obvious that this device also would have to be removed prior to the use of the engine.

SUMMARY OF THE INVENTION

The propeller locking mechanism device as disclosed in the present invention includes a special threaded nut which is threadably positioned on the shaft of the engine to securely and rigidly hold the propeller in proper position during use. This nut is arranged with a cylindrical surface on its end which provides the base support area for the locking cover. A pair of circumferential seals are provided on the cylindrical surface to provide a free-rotating condition for the outer cover while maintaining a waterproof seal for the internal parts. These seals can be O-rings which are spaced as far apart as possible to additionally support the cover so that it retains essentially a balanced condition to prevent vibration and the transmission of this vibration to the drive shaft and bearings of the engine. Thus, the only contact of the outer cover with the shaft is through the cushioned effect of the seals. A threaded bolt is used to secure the protective cover to the retaining nut. A shoulder is provided on the bolt which provides clearance between the bolt and cover to retain the rotational freedom of the cover.

The head of the retaining bolt is provided with a unique grooved configuration or pattern which matches a special individual wrench which prevents the removal of the bolt by unauthorized persons not having access to the wrench. A number of different pattern combinations are possible so that the risk of an unauthorized person finding the correct wrench for a specific locking device is minimal.

A threaded cap is provided to enclose the front recess of the cover. A seal is provided to seal the edge of the cap to prevent the entrance of moisture. The cap in turn shields the retaining bolt from view. The cap is not intended to provide a locking function although it could, if desired.

In the present arrangement, the outside surface of the cover and end cap is arranged to provide a streamlined ellipsoid or bullet-shaped configuration. It is necessary that the outer surface of at least the cover have a continuous curve so as to be free of flat surfaces. Thus, the outer surface is intended to be smooth to prevent the cover from being attached or gripped by hand or tools to prevent it from being turned against the undersurface of the bolt to prevent it from being loosened and removed. With the internal cavity of the device sealed to stop the entrance of water or moisture, a clean, corrosion-free atmosphere can be maintained which will retain the integrity of the locking device to permit it to be easily removed or installed when desired. At the same time it will prevent any kind of frictional force to be transmitted between the cover and the retaining bolt or nut to prevent their unauthorized removal.

It is expected that the materials utilized in fabricating the individual components of the locking device will be suitable to withstand the electrolytic corrosion effects of either fresh or salt water. In most cases it is anticipated that brass will be used throughout the device except possibly for the retaining bolt which can be a high-strength steel to provide additional security. The use of a dissimilar material for the bolt will not create a corrosion problem because the lock is internally sealed. The external parts, however, are intended to be fabricated from compatible materials which will prevent any type of corrosion and yet maintain the strength that is required. These materials can include other metals such as aluminum, or stainless steel, and various types of, plastics or synthetic resins. In many cases, the material consideration will be determined by the anticipated expense and the desired method of manufacturing.

It is to be understood that while reference is made to a specific marine propeller locking device as shown and described herein, any other variations of this device which utilizes one or more of the features described are to be considered part of this invention.

BRIEF DESCRIPTION OF THE DRAWINGS

Other features and advantages of the present invention will become apparent in the following detailed description of the invention wherein like reference numbers denote the same elements in the accompanying drawings.

DETAILED DESCRIPTION OF THE INVENTION

Figure 1:
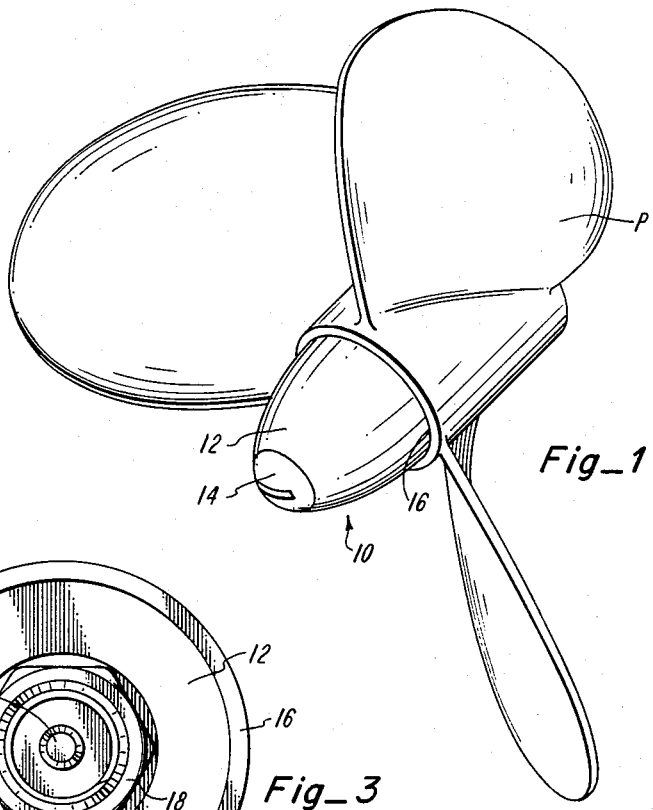
FIG. 1 is a perspective view showing a marine outboard engine propeller held in position by the locking device according to the present invention.
Figure 3:
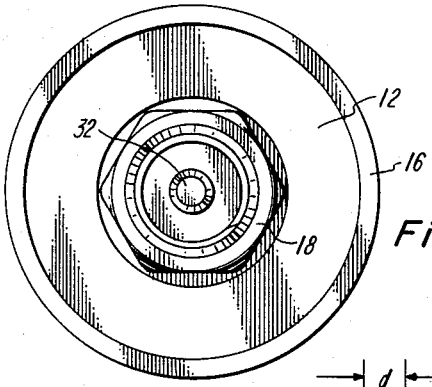
FIG. 3 is a rear view of the device showing the relationship between the cover and the retaining nut.
Figure 2:
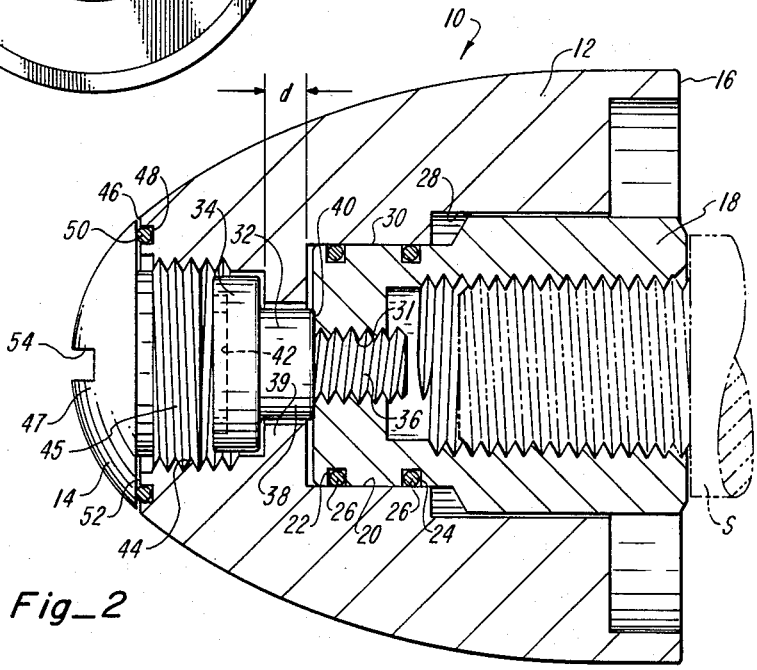
FIG. 2 is a cross-sectional view showing the shaft retaining nut and the free-rotating outer locking cover.

Turning now more specifically to the drawings, FIG. 1 shows a typical marine type propeller P held in retained position by the locking device 10 according to the present invention. The locking device 10 includes the cover 12 which has a smooth outer surface and the protective sealing cap 14. The rear edge 16 of the cover 12 is intended to be in close proximity but not touching the surface of the propeller P.

The purpose of the locking device 10 is to prevent access and direct contact with the retaining nut 18 which positions and holds the propeller P on the engine drive shaft S.

As will be described later the cover 12 and its associated cap 14 are intended to operate as a unit which is "free-floating". Although the outside surface of the cover 12 can be of any configuration such as cylindrical, if desired, it is primarily intended that because of the water dynamics, the surface will be a partial ellipsoid or bullet shape to allow the smooth flow of water around the outside surface yet have no surfaces or areas which could be easily gripped by hand or tools to apply a turning bias to the internal retaining bolt or nut.

The locking device 10 includes a suitable retaining nut 18 which is sized and threaded to fit the shaft of the intended marine outboard engine. At present, it is noted that there are approximately three different standard sizes and threads which have been utilized in the industry. Accordingly, three standard sized nuts are required to fit the shafts upon which the lock is intended to be used. It is understood that the parts making up the locking device can also be adjusted in size to correspond with the required sizing of the propeller retaining nut.

One end of the retaining nut 18 is formed in a cylindrical elongated portion 20. Two circumferential grooves 22, 24 are provided for retaining O-ring seals 26. The grooves 22, 24 are spaced longitudinally to provide lateral stability for the cover 12. The cover 12 has a cylindrical internal recess 28 with a stepped-down recessed surface 30 provided internally. The diameter of the internal recess 30 is sized precisely to fit the compressed outer diameter of the O-rings seals 26 positioned within the grooves 22, 24. In this way, a seal is provided between the surface 20 of the nut 18 and the internal cavity formed by the surface of the recess 30 provided within the cover 12. By this method, the cover 12 is adequately supported on the O-rings 26 so that it is free to turn or move without placing torque on the retaining nut 18 which could in any way possibly cause it to be removed from the shaft S. In addition, with the wide stance provided by the spacing of the O-ring grooves 22, 24 considerable lateral stability is imparted to the cover 12 to maintain a balanced condition necessary during operation of the engine.

A retaining bolt 32 having a flat head 34 is provided. The bolt 32 has a threaded end portion 36 and an enlarged body or shank 38 having a shoulder 40.

The length of the body 38 exceeds the width D of the partition 39 provided in the cover 12. Thus, there is clearance between the head 34 of the bolt 32 and the surface of the partition 39 which continues to allow the cover 12 to float free from any direct contact with the bolt 32 and retaining nut 18. The head 34 of the retaining bolt 32 includes a recessed groove 42 which has a non-standard distinct pattern to prevent it from being engaged and removed by any ordinary tools.

An internal threaded recess 44 is provided in the forward end of the cover 12 which is sized to closely fit the outer diameter of the bolt head 34 without actual contact. The protective cap 14 includes a threaded shank 45 and rounded head 47. The configuration of the head 47 is expected to be a continuation of the outer surface configuration of the cover 12. In this way, a continuous stream-lined surface for the outer appearance of the device is provided. A flat forward surface 46 is provided on the cover 12 and includes a circular groove 48 to retain an O-ring seal 50. The corresponding surface 52 of the head 47 is smoothly finished to provide a sealing surface for the O-ring seal. A slotted groove 54 is included for tightening the threaded cap 14 to the threaded recess 44 of the cover 12. Once this cap is installed, the interior of the locking device is sealed by seal 50 to prevent the entrance of water or moisture. In this way, there will be an absence of corrosion within the cover as well as the introduction of any other foreign matter or debris which would in any way prevent the free rotation of the cover on the retaining nut. The actual locking function as provided in the present device relies on the free turning of the cover without any substantial contact or drag applied to the retaining bolt 32 or nut 18 which could allow either one of these parts to be backed out and removed so as to expose and release the marine propeller.

OPERATION

Figure 4:
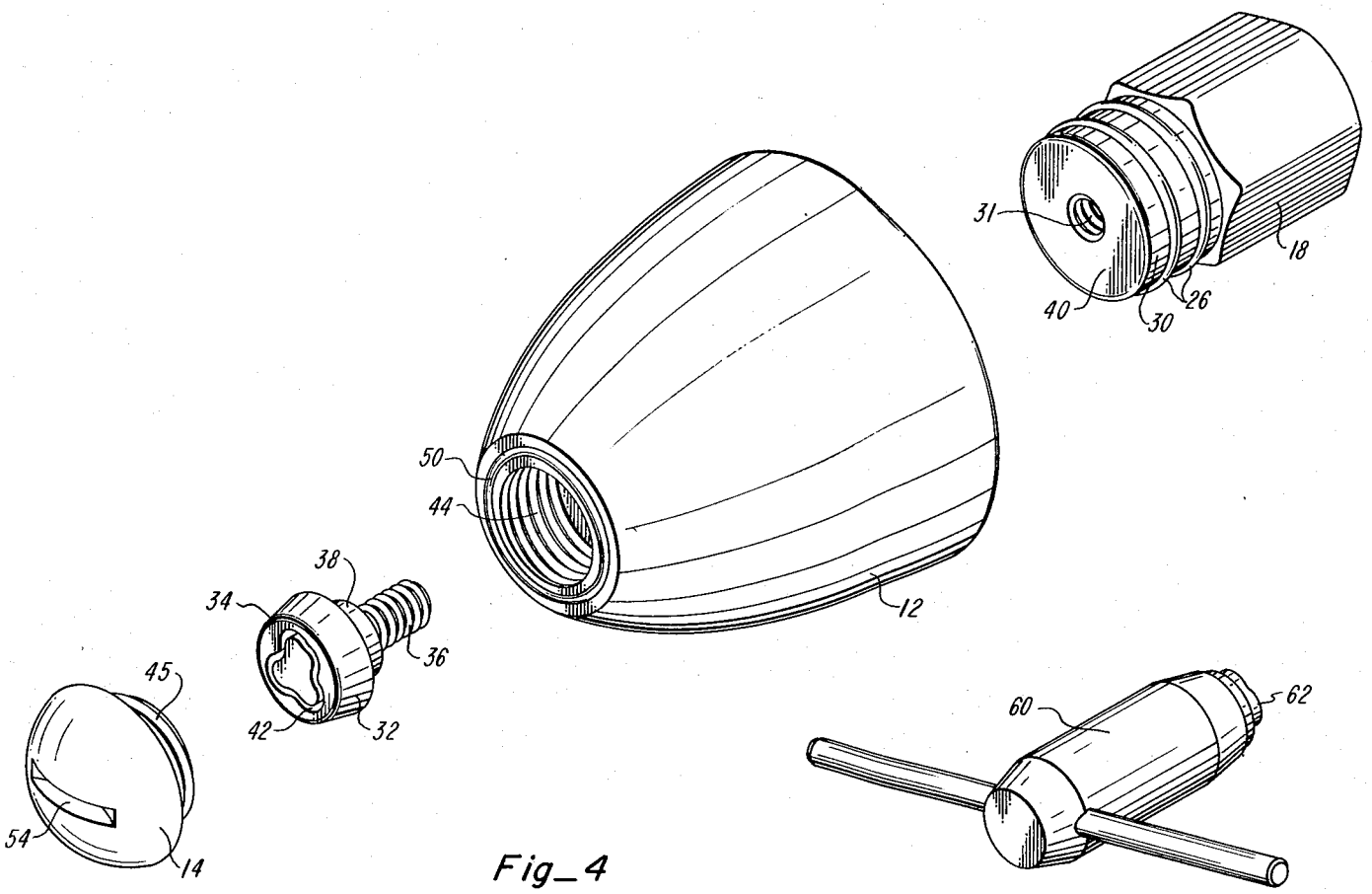
FIG. 4 is an exploded view of the parts which make up the locking device according to the present invention.

As seen in FIG. 4, the locking device according to the present invention is utilized by installing the retaining nut 18 on the threaded drive shaft of the applicable outboard motor. Once the retaining nut 18 is installed, the outer cover 12 of the device is slipped over the retaining nut 18 so that its internal recess will engage the O-ring seals 26. The retaining bolt 32 is inserted through the threaded recess 44 so that the threaded end 36 engages the threaded aperture 31 in the end of the retaining nut 18. A suitable hand wrench 60 having a fluted end 62 which matches the grooves 42 provided in the head of the bolt 32 is used to tighten the bolt securely to the retaining nut 18. The threaded shank 45 of the cap 14 is then screwed into the recess 44 provided in the cover 12 so that the cap will tightly seal against the O-ring 50 to provide a sealed internal environment. Once assembled, the free-turning capability of the cover 12 and the lack of gripping surfaces on the outer portion prevents any effective torque from being applied to either the retaining bolt 32 or nut 18.

To maintain the integrity of the locking device according to the present invention, it is anticipated that the groove pattern 42 in each of the various bolt heads 34 and wrench 60 combination will have different configurations which will make it difficult for any person to have the correct wrench which would remove a particular propeller locking device.

While throughout this application the illustrations and description have been directed to a marine outboard engine, it is to be understood that this locking device can be used on any marine propeller application such as is provided with the inboard/outboard type engine or with an inboard power system. The important consideration is the retention of the propeller to the drive shaft of the power train with the present locking device being applicable to any of these drive systems.

While a new and novel marine propeller locking device has been shown and described in detail in this application, it is to be understood that this invention is not to be considered to be limited to the exact form disclosed and changes in the detail and construction of the invention may be made without departing from the spirit thereof.

What is claimed is:

1. A locking device for marine propellers to prevent their removal from a power drive shaft of a marine engine, the device comprising:

(a) retaining means mounted on said drive shaft for securing the propeller to the drive shaft, said retaining means having an elongated cylindrical outer surface arranged coaxially with said drive shaft;

(b) cover means slidably mounted over said retaining means, said cover means being generally elongated and sized to surround and loosely fit over said retaining means to restrict access to and prevent unauthorized removal of the retaining means and propeller, the outer surface of said cover means being formed in a generally continuous curve and having no more than one flat surface to prevent a person or object from gripping and forcibly turning the cover in order to apply a removal force to the retaining means;

(c) said cover means having a central axis and a first cylindrical recess arranged coaxially with said central axis and extending inwardly from one end, said recess being sized to loosely fit the retaining means to allow the cover means to rotate with respect to said retaining means;

(d) said cover means further including a second cylindrical recess arranged coaxially with said central axis and extending inwardly from the opposite end of said cover means from said first recess, the interior ends of said first and second recesses being spaced apart so as to form a partition therebetween;

(e) bolt means mounted through an aperture in said partition to secure said cover means to said retaining means, said bolt means having a head and an enlarged shank forming a shoulder which has a longitudinal dimension between the head and shoulder which is slightly greater than the thickness of said partition whereby when said bolt means is tightened to said retaining means the cover means will remain free to turn without applying a turning force to the bolt means;

(f) cap means mounted in the end of the second recess of said cover means and sized to engagingly fit and close said second recess; and (g) wrench means having a gripping area at one end and a plurality of socket ridges having a non-standard pattern formed at the opposite end, said head of the bolt means having a plurality of recessed grooves formed therein which corresponds to the pattern formed by the socket ridges of said wrench means whereby only the corresponding wrench means can be used to install or remove said bolt means.

2. A marine propeller locking device as defined in claim 1 wherein the retaining means has a threaded internal recess formed at one end which is sized to mountingly fit threads formed on the intended power drive shaft.

3. A marine propeller locking device as defined in claim 1 wherein the outer cylindrical surface of said retaining means includes a pair of sealing means being circumferentially and spacedly arranged on said retaining means cylindrical surface, the first cylindrical recess of said cover means being sized to suitably fit over the seal means on said retaining means to prevent liquid from passing between the retaining and cover means while allowing the cover means to rotate with respect to the retaining means, and a seal means provided between said cap means and the end of said cover means to prevent liquid from entering the recess in the interior of said cover means to prevent corrosion and the introduction of foreign matter.

4. A marine propeller locking device as defined in claim 3 wherein said seal means are O-rings positionally mounted in circumferential grooves formed around said elongated cylindrical surface, said grooves being spaced along said cylindrical surface a distance greater than 50% of the diameter of said cylindrical surface.

5. A marine propeller locking device as defined in claim 1 wherein a substantial portion of the outer surface of said cover means is formed in the shape of a partial ellipsoid.

6. A marine propeller locking device as defined in claim 1 wherein said second cylindrical recess is threaded and said cap means has threads which engagingly fit the threads of said second recess.

7. A marine propeller locking device as defined in claim 3 wherein the sealing means for said cap means is an O-ring seal mounted in a recessed groove formed around the outer edge of the cover means.

8. A marine propeller locking device as defined in claim 1 wherein the outer diameter of the head of said bolt means and the inside diameter of said second cylindrical recess closely fit to prevent an object from gripping the sides of said bolt means.

9. A marine propeller locking device as defined in claim 1 wherein the threads on said bolt means are arranged in a predetermined direction whereby the bolt means will generally tighten in response to the rotational direction of the marine propeller drive shaft.

* * * * *